US005215685A

United States Patent [19]

Marino

[11] Patent Number: 5,215,685

[45] Date of Patent: Jun. 1, 1993

[54] HUMIDIFIER WITH WATER SEALED IMPELLER UNIT

[75] Inventor: Frank Marino, Upton, Mass.

[73] Assignee: Duracraft Corporation, Whitinsville, Mass.

[21] Appl. No.: 868,517

[22] Filed: Apr. 15, 1992

[51] Int. Cl.[5] ..... B01F 3/04

[52] U.S. Cl. ..... 261/72.1; 261/91

[58] Field of Search ..... 261/91, DIG. 4, 72.1, 261/29

[56] References Cited

U.S. PATENT DOCUMENTS

| | | | |
|---|---|---|---|
| 3,130,246 | 4/1964 | Banks | 261/91 |
| 3,168,596 | 2/1965 | Jamison | 261/91 |
| 3,283,478 | 11/1966 | Katzman et al. | 261/29 |
| 3,348,821 | 10/1967 | Martin et al. | 261/29 |
| 3,605,385 | 9/1971 | Stoop | 261/91 |
| 3,687,424 | 8/1972 | Katzman et al. | 261/72.1 |
| 4,301,094 | 11/1981 | Baus | 261/29 |
| 4,350,646 | 9/1982 | Baus | 261/29 |
| 4,399,080 | 8/1983 | Swank | 261/91 |
| 4,657,713 | 4/1987 | Miller | 261/104 |

*Primary Examiner*—Tim Miles

*Attorney, Agent, or Firm*—John E. Toupal; Harold G. Jarcho

[57] ABSTRACT

A humidifier including a base enclosure defining a reservoir to be filled with liquid, an opening disposed above the reservoir, and a discharge orifice communicating therewith; a humidification unit mounted on the base, covering the opening and adapted to produce dispersion of liquid retained by the reservoir; the humidification unit being separable from the base along a joint extending around the opening; and a seal mechanism including a channel for receiving liquid disposed to form a seal preventing the passage through the joint of liquid dispersed by the humidification unit. This arrangement provides a vapor seal for power units that expel vapor through a distinct discharge orifice.

20 Claims, 1 Drawing Sheet

HUMIDIFIER WITH WATER SEALED IMPELLER UNIT

BACKGROUND OF THE INVENTION

This invention relates generally to a portable humidifier and, more particularly, to a portable humidifier having a liquid dispersion unit removably mounted on a reservoir defining base along a water sealed joint.

Portable humidifiers are extensively used to increase humidity and thereby improve environmental comfort. Typical humidifiers employ some form of power unit for inducing dispersion of liquid retained in a liquid reservoir. The dispersed liquid, generally in the form of vapor, is expelled through a discharge passage into the surrounding environment. Under certain operating conditions, some of the discharged vapor will condense on the walls of the discharge passage and will drain therefrom back into the liquid reservoir. However, condensation can produce problems for those humidifiers having a dispersion power unit removably mounted on a reservoir defining base. Because the joints between removable power units and bases generally are not tightly sealed, inadvertent escape of vapor through the joint can result in condensation on outer walls of the dispersion unit. Such collected condensation can eventually drip undesirably onto a supporting surface such as a floor or table.

The object of this invention, therefore, is to provide a portable humidifier in which the above noted problems are alleviated.

SUMMARY OF THE INVENTION

The invention is a humidifier including a base enclosure defining a reservoir to be filled with liquid, an opening disposed above the reservoir, and a discharge orifice communicating therewith; a humidification unit mounted on the base, covering the opening and adapted to produce dispersion of liquid retained by the reservoir; the humidification unit being separable from the base along a joint extending around the opening; and a seal mechanism including a channel for receiving liquid disposed to form a seal preventing the passage through the joint of liquid dispersed by the humidification unit. This arrangement provides a vapor seal for power units that expel vapor through a distinct discharge orifice.

According to one feature of the invention, the joint and channel are annular and surround the opening. The annular channel insures complete sealing of the annular joint between the humidification unit and the base.

According to other features of the invention, the base defines an annular support surface, the humidification unit defines an annular supported surface engaged with the support surface along the annular joint, the annular channel is defined by the support surface, and the seal mechanism includes an annular projection skirt defined by the supported surface and extending downwardly into the annular channel. This arrangement provides the vapor seal in an efficient, compact configuration.

According to yet another feature of the invention, the humidification unit includes a motor, and an impeller rotatably coupled to the motor and projecting into the reservoir. The annular joint between the unit and the base is fully sealed by the annular channel and skirt.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
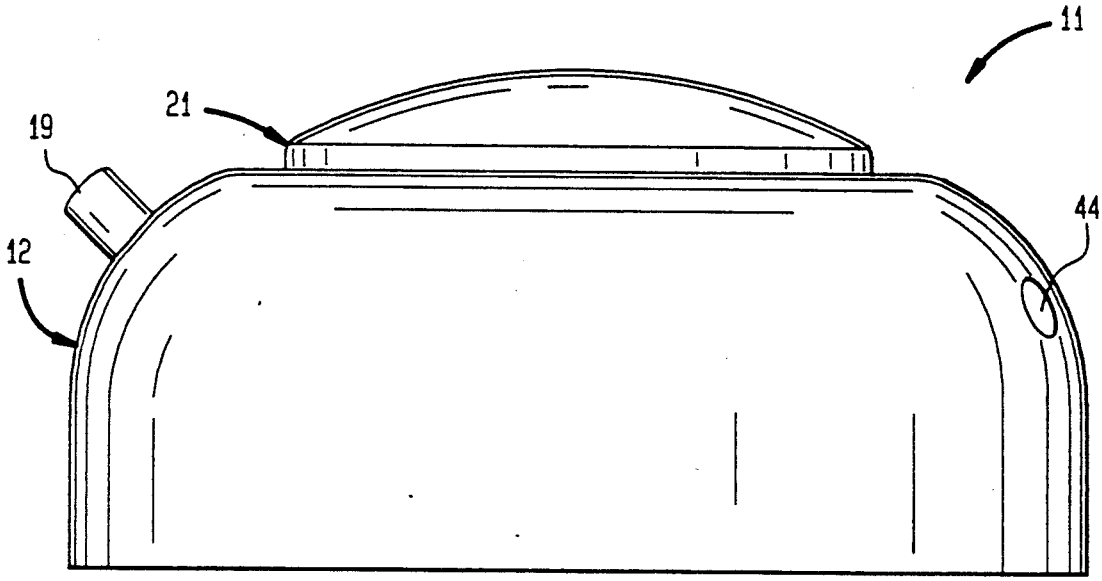
FIG. 1 is an elevational view of a humidifier according to the invention.
Figure 2:
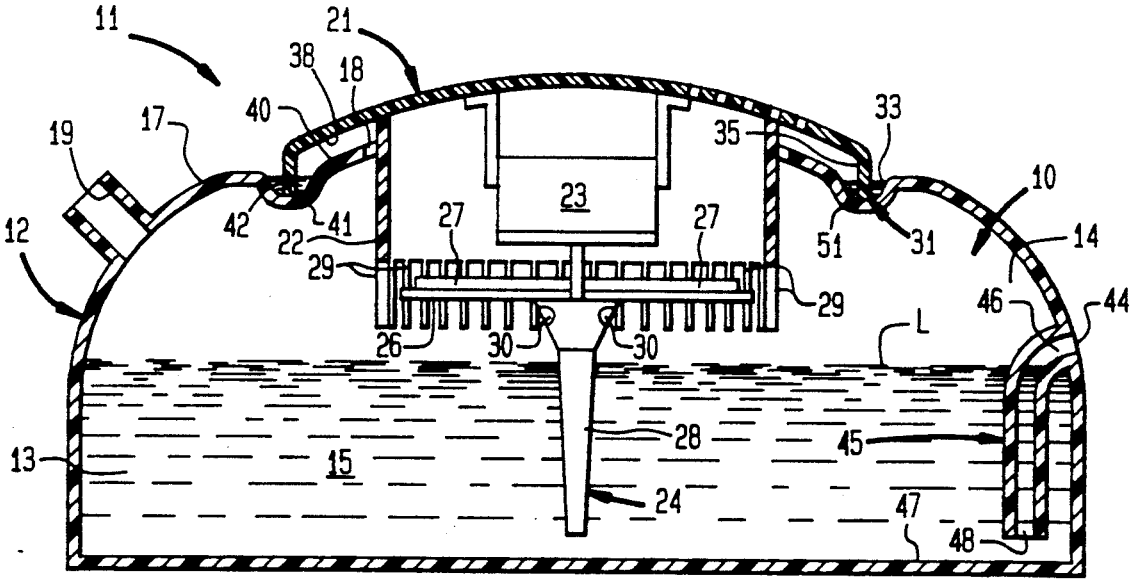
FIG. 2 is a transverse cross sectional view of the humidifier shown in FIG. 1.

A humidifier 11 includes a base enclosure 12 forming a discharge chamber 10 with a lower portion 13 that defines a reservoir for liquid 15. A cover portion 17 of the base enclosure 12 forms an upper portion 14 of the chamber 10 and defines a circular opening 18 disposed above the reservoir 14 and a discharge orifice 19 communicating therewith. Also included in the humidifier 11 is a humidification unit 21 supported by the upper wall portion 17 of the base enclosure 12. The humidification unit 21 includes a cylindrical housing 22 defining an inlet chamber 20, a motor 23 retained within the housing 22 and an impeller unit 24 rotatably coupled with the motor 23. Forming the impeller unit 24 is a plate 26 defining upwardly directed vanes 27 and a hollow inverted cone 28 projecting downwardly into the reservoir 14 within the base enclosure 12. A diffuser assembly includes a plurality of circumferentially spaced apart spokes 29 formed on the bottom of the housing 22 and disposed above and radially outside the hollow cone 28. Defined in an upper portion of the cone 28 are a plurality of apertures 30.

An annular joint 31 between the humidification unit 21 and the upper wall portion 17 permits separation thereof. Providing a vapor seal for the annular joint 31 is a sealing mechanism including an annular channel 33 defined by the upper wall portion 17 and surrounding the opening 18 therein and an annular skirt 35 formed at an outer lower periphery of the humidification unit 21 and projecting downwardly into the annular channel 33. A bottom edge 41 of the annular skirt 35 forms a supported surface of the humidification unit 21 that is supported by a support surface 42 of the base enclosure 12 formed by the bottom of the annular channel 33. Sloping toward the channel 33 is an inner surface portion 38 of the unit 21 disposed within the joint 31 and communicating with the discharge chamber 10 via a passage 39 between the opening 18 and the housing 22. Similarly sloping toward the channel 33 is an interior surface portion 40 of the base enclosure 12 also communicating with the reservoir via the passage 39.

Also formed in the upper portion 17 of the base enclosure 12 and in the upper portion 14 of the chamber 10 is an overflow port 44. A tube 45 extends between the overflow port 44 and the lower portion 13 of the chamber 10. One open end 46 of the tube 45 terminates at the overflow port 44 while another open end 48 of the tube 45 terminates closely adjacent to a bottom 47 of the chamber 10.

OPERATION

Prior to operation of the humidifier 11, the reservoir 13 is filled with liquid 15 and the annular channel 33 is filled with water 51 to form a liquid seal between the annular skirt 35 and the annular channel 33. Subsequent electrical energization of the motor 23 produces rotation of the impeller 24. The rotating cone 28 produces within the reservoir 13 centrifugal forces that force water upwardly for discharge through the apertures 30.

Water ejected through the apertures 30 is directed against the spokes 29 of the diffuser assembly 26 which breaks the water into fine mist droplets. Because of a positive pressure produced in the chamber 10 by the air moving vanes 27, the mist droplets produced by the humidification unit 21 are discharged through the discharge orifice 19 into the surrounding environment. However, discharge of droplets through the annular joint 31 between the humidification unit 21 and the base enclosure 12 is prevented by the water seal 51 created between the annular channel 33 and the annular skirt 35. Consequently, an undesirable accumulation of condensation on the outer surfaces of the humidification unit 21 and the base enclosure 12 is prevented. During operation of the humidifier 11, a seal is maintained by liquid that passes from the discharge chamber 10 through the passage 39, collects on the inner surface portion 38 of the unit 21 and the interior surface portion 40 of the base enclosure 12 and then drips into the annular channel 33.

The overflow port 44 establishes a maximum liquid level L within the chamber 10 by draining any liquid above that level caused either by overfilling of the enclosure 12 or liquid movement produced by the impeller 24. Thus, undesirable submersion of the electrical motor 23 is prevented. In addition, undesirable discharge through the overflow port 44 of liquid dispersed by the impeller 24 is prevented by the tube 45 which extends into the liquid 15 to create a liquid seal for the overflow port 44.

Obviously, many modifications and variations of the present invention are possible in light of the above teachings. It is to be understood, therefore, that the invention can be practiced otherwise than as specifically described.

What is claimed is:

1. A humidifier comprising:

base enclosure means defining a reservoir to be filled with liquid, an opening disposed above said reservoir, and a discharge orifice communicating with said reservoir;

humidification means mounted on said base means, covering said opening, defining with said base enclosure means an inlet chamber for receiving air from the environment and a discharge chamber communicating with said inlet chamber and said discharge orifice, and comprising impeller means projecting into the liquid and adapted to produce dispersion thereof into said discharge chamber; said humidification means being separable from said base means along a joint extending around said opening; and seal means comprising a channel communicating with said discharge chamber so as to receive therefrom liquid disposed to form a seal preventing the passage through said joint of liquid dispersed by said humidification means.

2. A humidifier according to claim 1 wherein said joint and said channel are annular and surround said opening.

3. A humidifier according to claim 2 wherein said annular channel is defined by said base means; and said seal means further comprises an annular projection defined by said humidification means and extending downwardly into said annular channel.

4. A humidifier according to claim 3 wherein said base means defines an annular support surface, and said humidification means defines an annular supported surface engaged with said support surface along said annular joint.

5. A humidifier according to claim 4 wherein said channel forms said support surface.

6. A humidifier according to claim 5 wherein said projection forms said supported surface.

7. A humidifier according to claim 6 wherein said projection is an annular skirt projecting downwardly from an outer periphery of said humidification means.

8. A humidifier according to claim 2 wherein said humidification means is centrally mounted on said base means.

9. A humidifier according to claim 8 wherein said annular channel is defined by said base means; and said seal means further comprises an annular projection defined by said humidification means and extending downwardly into said annular channel.

10. A humidifier according to claim 9 wherein said base means defines an annular support surface, and said humidification means defines an annular supported surface engaged with said support surface along said annular joint.

11. A humidifier according to claim 10 wherein said channel forms said support surface.

12. A humidifier according to claim 11 wherein said projection forms said supported surface.

13. A humidifier according to claim 12 wherein said projection is an annular skirt projecting downwardly from an outer periphery of said humidification means.

14. A humidifier according to claim 2 wherein said humidification means comprises a motor, and an impeller rotatably coupled to said motor and projecting into said reservoir.

15. A humidifier comprising:

base means defining a reservoir to be filled with liquid;

humidification means mounted on said base means, defining with said base means an inlet chamber for receiving air from the environment and a discharge chamber communicating with said inlet chamber, and comprising impeller means projecting into the liquid and adapted to produce dispersion thereof into said discharge chamber; said humidification means covering said reservoir and being separable from said base means along a joint located above and extending around said reservoir; and seal means comprising a channel communicating with said discharge chamber so as to receive therefrom liquid disposed to form a seal preventing the passage through said joint of liquid dispersed by said humidification means, and wherein said base means and said humidification means further define a passage providing between said discharge chamber and said channel a flow path for liquid dispersed by said humidification means.

16. A humidifier according to claim 15 wherein said humidification means defines inner surface portions within said joint, disposed to receive liquid dispersed by said humidification means, and sloped toward said channel.

17. A humidifier according to claim 16 wherein said joint and said channel are annular and surround said opening.

18. A humidifier according to claim 15 wherein said base means defines interior surface portions within said joint, disposed to receive liquid dispersed by said humidification means and sloped toward said channel.

19. A humidifier according to claim 18 wherein said joint and said channel are annular and surround said opening.

20. A humidifier according to claim 19 wherein said humidification means defines inner surface portions within said joint, disposed to receive liquid dispersed by said humidification means, and sloped toward said channel.

* * * * *